US005857644A

United States Patent [19]

Küsters

[11] Patent Number: 5,857,644

[45] Date of Patent: Jan. 12, 1999

[54] HOMING PROCESS

[76] Inventor: Manfred Küsters, Südstr. 12, 83607 Holzkirchen, Germany

[21] Appl. No.: 199,365

[22] Filed: May 13, 1988

[30] Foreign Application Priority Data

May 13, 1987 [DE] Germany ..... 37 15 909.7

[51] Int. Cl.[6] ..... F41G 7/00

[52] U.S. Cl. ..... 244/3.15; 244/3.16

[58] Field of Search ..... 244/3.15, 3.16, 244/3.17

[56] References Cited

U.S. PATENT DOCUMENTS

| | | | |
|---|---|---|---|
| 3,459,392 | 8/1969 | Buynak et al. | 244/3.17 |
| 3,695,555 | 10/1972 | Chadwick | 244/3.16 |
| 3,737,120 | 6/1973 | Green | 244/3.17 |
| 3,778,007 | 12/1973 | Kearney, II et al. | 244/3.17 |
| 4,198,015 | 4/1980 | Yates et al. | 244/3.15 |
| 4,277,038 | 7/1981 | Yates et al. | 244/3.15 |
| 4,307,650 | 12/1981 | Kuesters et al. | 89/1.5 E |
| 4,359,732 | 11/1982 | Martin | 343/5 CM |
| 4,407,465 | 10/1983 | Meyerhoff | 244/3.16 |
| 4,514,733 | 4/1985 | Schmidtlein et al. | 343/5 MM |
| 4,530,270 | 7/1985 | Denaci | 89/1.11 |

FOREIGN PATENT DOCUMENTS

| | | | |
|---|---|---|---|
| 2803036 | 7/1970 | Germany | 244/3.15 |
| 2831825 | 1/1980 | Germany | 244/3.17 |
| 3129800 | 1/1984 | Germany . | |
| 3110691 | 7/1985 | Germany | 244/3.17 |
| 3411439 | 9/1985 | Germany | 244/3.17 |
| 2116000 | 9/1983 | United Kingdom . | |
| 2149066 | 10/1983 | United Kingdom . | |
| 2128300 | 4/1984 | United Kingdom . | |
| 2141809 | 5/1984 | United Kingdom . | |

OTHER PUBLICATIONS

Wanstall, B.; "New Weapon for the Mud Mover"; *Interavia;* Feb. 1987; pp. 125–129.

*Primary Examiner*—Charles Jordan
*Assistant Examiner*—Theresa M. Wesson
*Attorney, Agent, or Firm*—Cushman Darby & Cushman IP Group of Pillsbury Madison & Sutro

[57] ABSTRACT

The invention describes a target approach procedure for a guided, mobile missile for use against ground targets, particularly bridges, roads, rail junctions, hangars, shelters, command posts, harbor installations as well as ships, in which the missile is released at a great distance from the target and flies automatically to the target, with guidance by parallel lines that characterize ground structures, and hits it from the most favorable approach direction.

19 Claims, 4 Drawing Sheets

Figure 1:
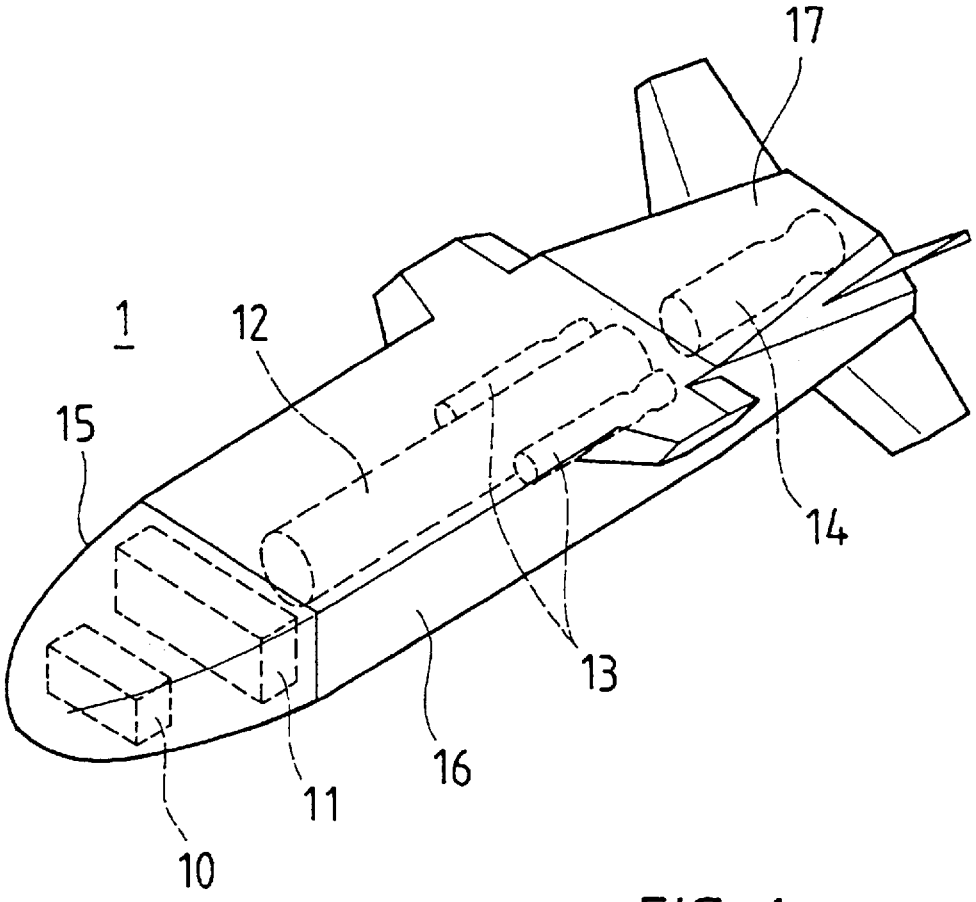

FIG. 4
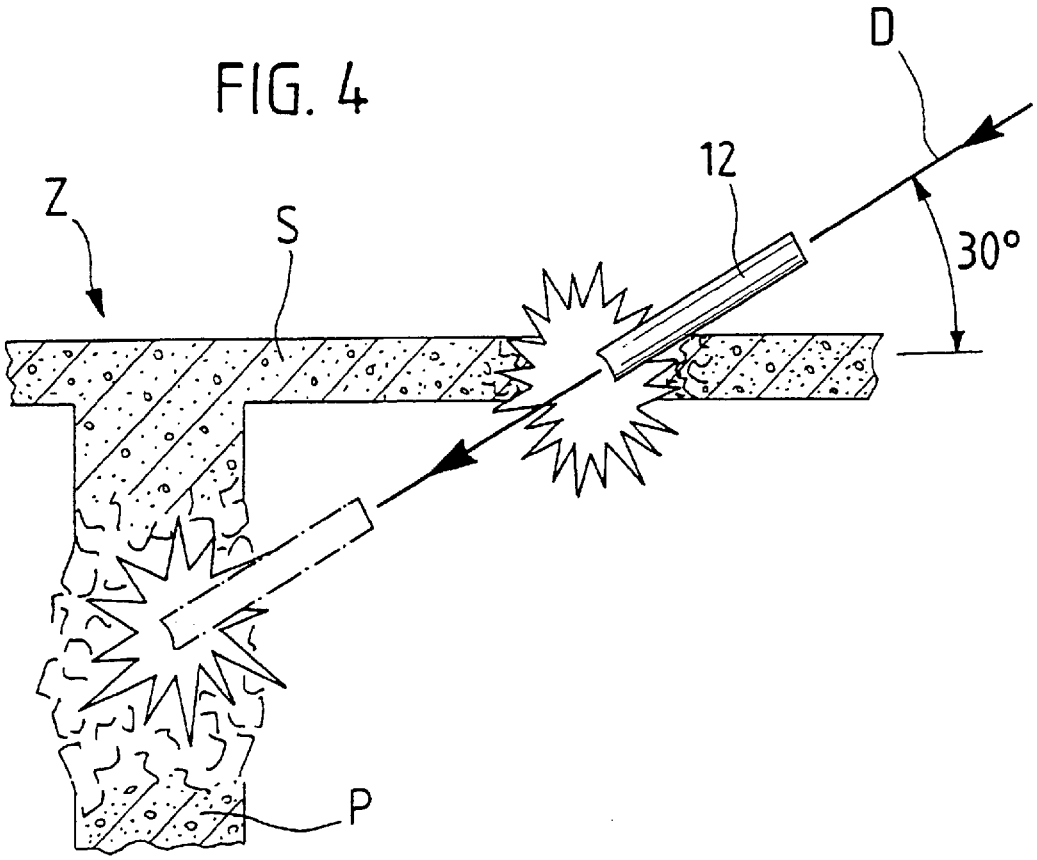
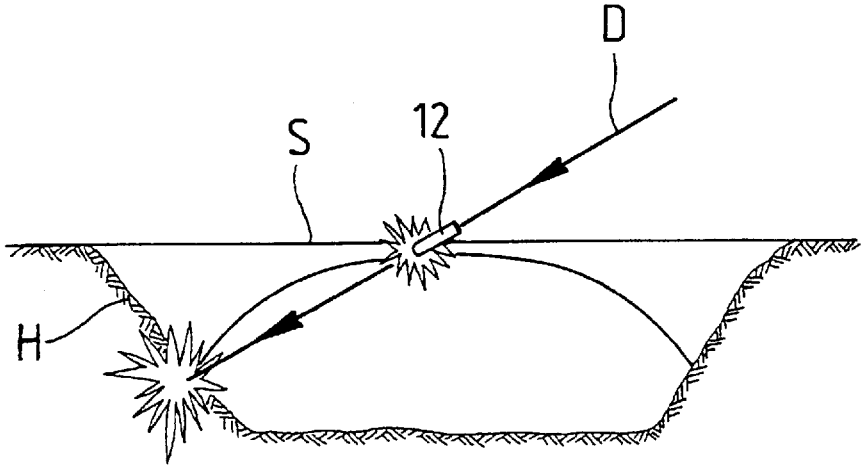
FIG. 5

HOMING PROCESS

The invention concerns a target approach procedure for a guided missile with a search head, guide electronics and a warhead and which is launched by a carrier flight device at a greater distance from the target and approaches the target in a guided manner.

It is known from the literature (Interavia 2/1987, p. 125–129; B. Wanstall: New weapon for the Mud Mover) to fight point targets, such a bridges in particular, with guided bombs. These types of guided bombs are launched near the target and then reach their target in a steep dive. They are equipped with active laser search heads which acquire the target during final approach and permit a limited correction of the dive trajectory. Another version is equipped with a TV or IIR search head (Imaging Infra-Red), the pictures of which are radioed back to the carrier plane. The corresponding guidance information is then transmitted by the inflight computer of the carrier plane to the guided bomb. Only in its direct target approach phase does the bomb guide itself to the target.

In addition an automotive guided bomb has become known (Type: AGM-130A), which is launched at a great distance from the target and flies to the target with the aid of a cruise engine. The search head is equipped with a TV camera as well as with a radar altitude meter, guidance electronics and an automatic pilot. The control of the missile to the target is done by a weapon systems officer.

This also discloses the disadvantages of both systems, on the one hand, the detectability and ability to interfere with the active search head and the guidance data transmission as well as the dangerous approach by the carrier aircraft to the target and, on the other hand, the need for data transmission between the weapon system officer and the missile over a considerable distance. In addition, it has not always been possible with the known approach procedures to effectively and completely destroy the targets as it was necessary to approach the targets from an unsuitable approach direction with high impact precision.

For this reason the invention is based on the problem to suggest an approach procedure for a propelled missile which avoids the above cited disadvantages and permits an automatic, very precise approach to a ground target, particularly a bridge, whereby the target will be hit effectively.

The problem is solved by the characteristics of the target approach procedure described in the characterizing part of the principal claim. Advantageous developments can be seen in the dependent claims.

The invention is based on the idea that generally terrain characteristics lead to each bridge which are characterized by approximately parallel lines, such as roads, rail lines, canals etc. The bridge itself is also characterized by parallel lines in its longitudinal direction. This results in the essential advantages of the invention which are seen in the fact that the missile is discharged at a safe distance from the target and then automatically determines its position based on the approximately parallel running terrain characteristics of a road or rail line leading to the target and essentially flies to the target along it. In addition, it is a particular advantage that the bridge is approached in its longitudinal direction. This increases the impact probability and makes possible, contrary to all other approach procedures, a targeted fight against the bridge piers or their foundations, even if they do not extend across the whole width of the bridges.

Figure 2:
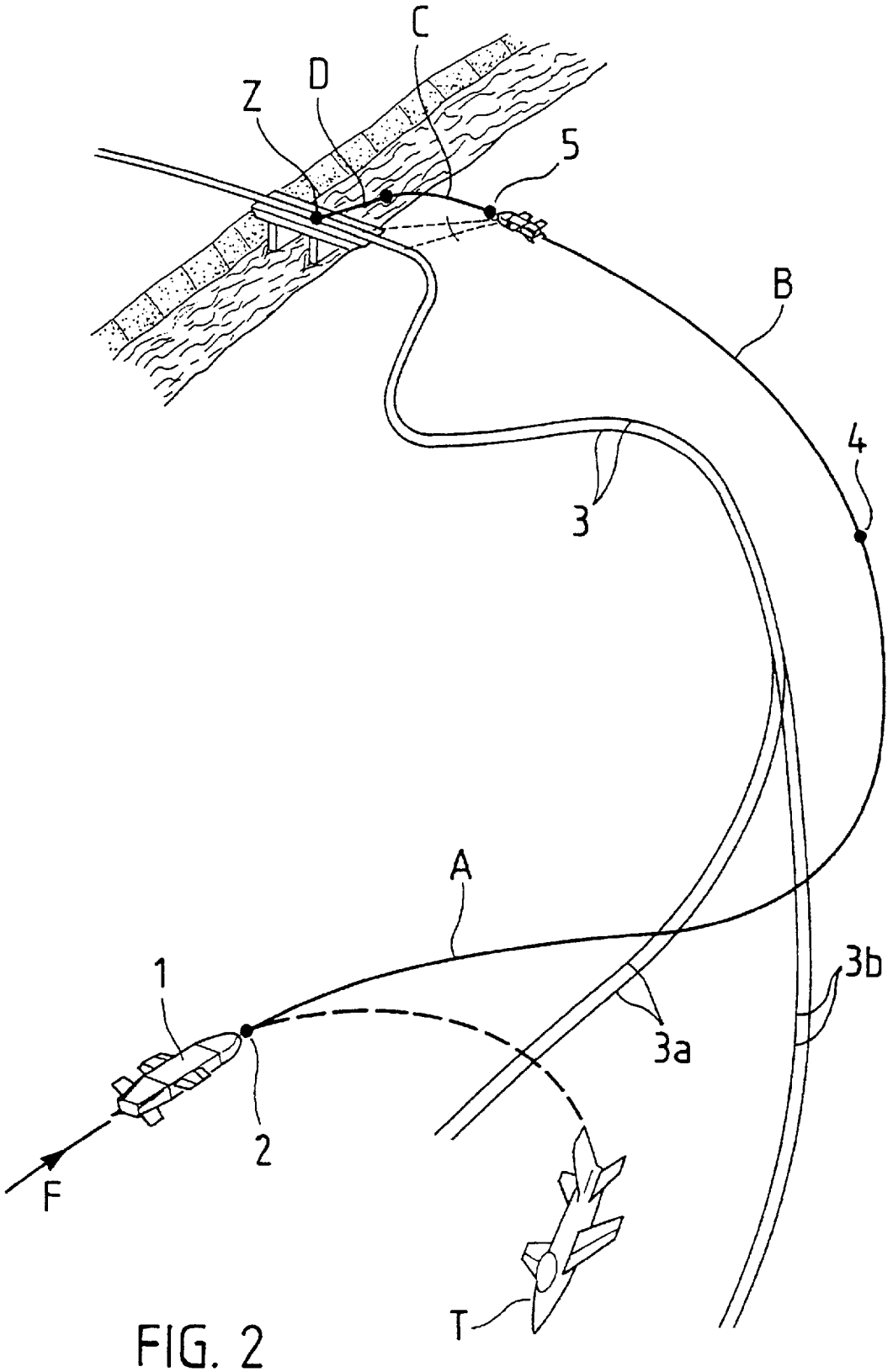
Figure 3:
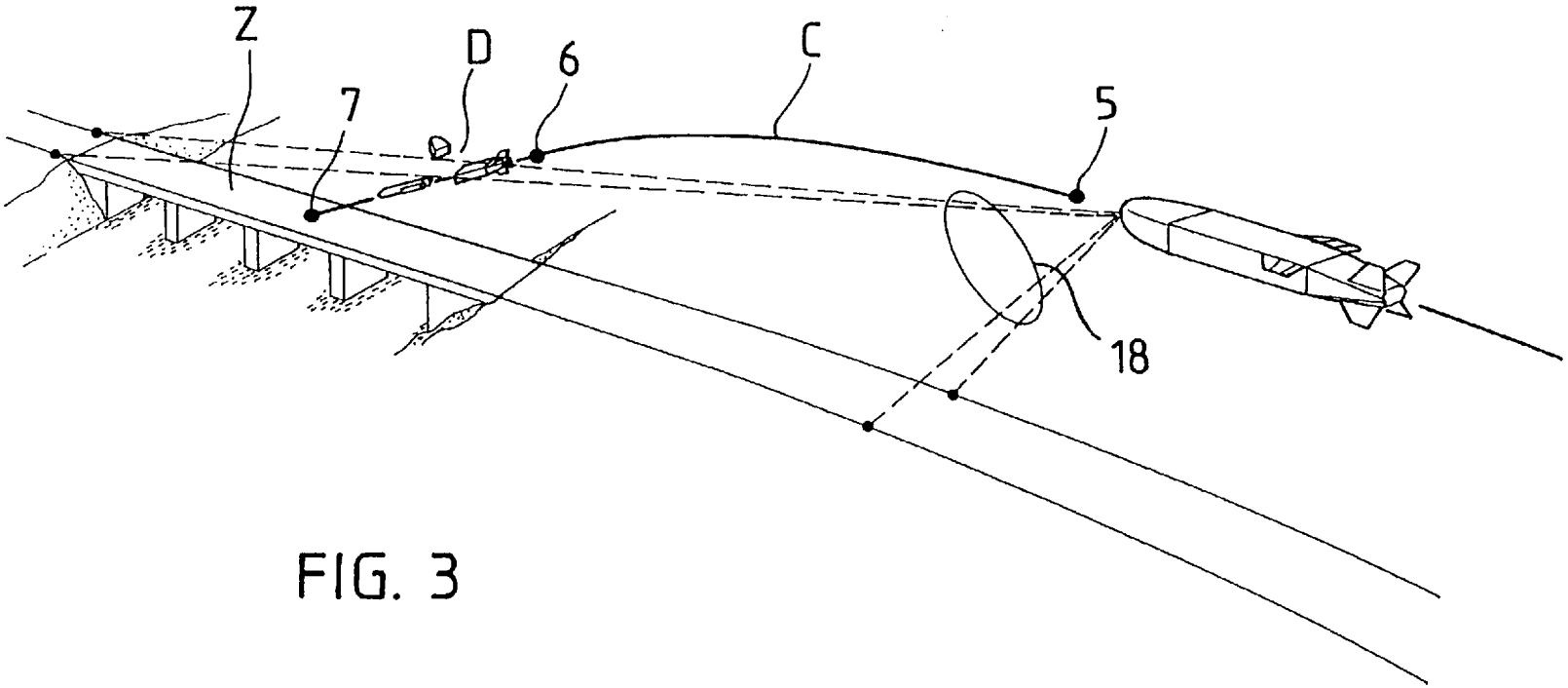

The invention is shown on the basis of an example in the drawing and is further described below. Shown are:

FIG. 1 a simplified view of the missile used for the target approach procedure, FIG. 2 the trajectory of the missile according to the approach procedure, FIG. 3 the last flight phase before the target, FIG. 4 the target impact in the case of a bridge with piers, FIG. 5 the target impact on an arched bridge.

In FIG. 1 a modularly constructed missile 1 is shown in a schematically simplified manner. It consists of three sections 15, 16, 17 which can be equipped in different manners, depending on the application of the missile. In the example shown, the nose part 15 contains the passive search head 10 and the pertaining guidance electronics 11 which executes the evaluation of the signals furnished by the search head. The middle section 16 contains a warhead 12 with one or several own engines 13. If needed, it is also possible to arrange other electronic components—not shown in FIG. 1—in the middle part 16. The tail section 17 contains the cruise engine 14 of the missile.

FIG. 2 shows a typical course of a mission according to the invention. The missile 1 is brought by a carrier aircraft T on the trajectory F to point 2 and launched there at a distance of about 5 . . . 30 km from the target Z.

During the following first flight phase A after launch the search head 10, 11 of the missile 1 searches the area in front of it along the terrain it is flying over for segments of parallel running lines 3*a*, 3*b* of the ground structure. In FIG. 2 these are shown simplified as train tracks.

In the electronics 11 which are part of the search head, data on the terrain characteristics from the surroundings of the target Z, obtained before the mission, have already been stored in the memory. These could have been obtained, for example, according to one of the known cartographic methods. The picture data obtained by the search head and the terrain data in the memory are processed in such a manner in the electronics that they are compared to each other for agreement. Consistent characteristics then make it possible to exactly determine the position and flight direction of the missile 1.

From this, the guidance electronics of the missile determines the necessary correction of the flight trajectory F so that still in flight phase A the pivoting into a flight trajectory is done, which is characterized in FIG. 2 partially by parallel lines, and will possibly lead directly to the target Z. It is absolutely possible that the ground structure characterized by parallel lines will not lead directly to the target. For flight guidance a sectional control of the flight trajectory is sufficient.

During the second flight phase B, starting at point 4, the missile only follows track 3 to the target in low level flight. Depending on the distance from the target, the cruise engine 14 of the missile is activated during flight phase B or already during flight phase A. The second flight phase B lasts to the reaching of point 5.

Shown in FIG. 3 is the now following direct target approach with the flight phases C and D, starting at point 5. Point 5 is defined by the fact that target Z enters into the acquisition range 18 of the search head 10. As soon as target Z can be completely acquired, the most favorable impact point 7 is determined by the guidance electronics and the trajectory of the missile directed towards it. This means that the missile changes in flight phase C to a target approach at about 30° incline from the horizontal. Here it is possible, with sufficient advance knowledge about the structure of the target, such as outside piers of a bridge, to have an approach laterally offset from the target center. This process is concluded at point 6 of the flight trajectory.

In the now following flight phase D, directed straight at the impact point 7, the warhead 12, housed in the middle section 16, is accelerated from it with the aid of one or several engines 13, whereby the no longer needed search head is jettisoned with the nose part 15 of the missile or pierced. In this manner, the warhead attains about double the approach speed.

FIGS. 4 and 5 show two different target impact situations with differing bridge constructions. In the target impact according to FIG. 4 the warhead 12 penetrates the roadway S of the bridge, penetrates then part-way into the pier P and explodes there. The penetration process into the pier can be supported, for example, with the use of a tandem charge in the warhead 12 with the additional ignition of a borehole charge.

In a target impact according to FIG. 5 the warhead penetrates again the roadway S of bridge Z and explodes then at an optimal depth in the foundation H of the arched bridge. Thus, the greatest possible effect of the warhead has been attained in both cases.

I claim:

1. A target approach procedure for a guided missile having a search head, guidance electronics and a warhead and which is launched by a carrier flight device at a great distance from a target and approaches the target in a guided manner, wherein the missile is guided from a launch site over earth to the target on a trajectory characterized by the following flight phases (A, B, C, D):

a) in a first flight phase (A) after launch of the missile a passive search head of the missile searches the earth in a given flight direction for a ground structure having sections of approximately parallel running lines, stores in said guidance electronics characteristics of such a ground structure and automatically compares those characteristics in the guidance electronics with stored terrain characteristics and determines from this the position of the missile relative to such a ground structure;

b) in a second flight phase (B) the missile automatically follows a selected ground structure leading to the target, characterized by segments of about parallel lines, up to a point of the flight trajectory (A, B, C, D) where the target can just be acquired;

c) in a third flight phase (C) the missile, after acquisition of the target by the search head, changes from an approximately horizontal flight position of the second flight phase (B) to a trajectory about 30° deviating from the horizontal and directed toward an optimal impact point in the target, which is continued in a straight line (D) until target impact; and d) after reaching a straight-line flight phase (D), the warhead is accelerated by means of its own engine.

2. Target approach procedure for a guided, mobile missile according to claim 1, wherein during at least one of the first and second flight phases (A, B) an engine of the missile is ignited.

3. Target approach procedure according to claims 1 or 2, wherein at least one of the first (A) and second flight phases (B) is executed as low level flight.

4. Target approach procedure according to claim 1 or 2, wherein the warhead is accelerated within the missile and separated therefrom during flight phase (D).

5. Target approach procedure according to claim 1, wherein the warhead charge of the missile includes two charges which are executed in tandem at the target.

6. Target approach procedure for a guided, mobile missile towards a bridge according to claim 1 or 5, including triggering of the warhead charge only after penetration of a roadbed or rail bed in a pier or a foundation of the bridge.

7. Method of determining the trajectory of a launched missile toward a target comprising:

seeking and finding via a launched missile itself a ground structure having approximately parallel lines running toward said target, and causing said missile to follow those lines toward said target.

8. Method of determining the trajectory of a launched missile toward a target comprising:

searching the terrain by said launched missile for a ground structure continuously having approximately parallel running lines running toward said target, comparing in said missile characteristics of searched terrain with previously stored terrain characteristics to cause the missile to follow the approximately parallel lines of a selected ground structure toward said target in a generally horizontal flight path until said missile acquires said target, and then changing the flight path of the missile to head downward toward said target while following the parallel lines of said selected ground structure.

9. A method as in claim 8 including correcting in the missile the flight path of the missile so that the missile will follow the parallel lines of said selected ground structure toward said target.

10. A method as in claim 8 including determining in the missile the most favorable impact point for impacting the target before said changing of the flight path.

11. A method as in claim 10 wherein said missile includes a warhead and engine means, said method including operating said engine means to said warhead away from at least part of said missile and directly to said impact point at substantially increased speed.

12. In a missile, apparatus for determining the trajectory of a launched missile toward a target, comprising:

means for seeking and finding a given ground structure having approximately parallel lines running toward said target, and means for causing said missile to follow those lines toward said target.

13. Apparatus as in claim 12 wherein said seeking and finding means includes in the missile:

means for storing before launch the terrain characteristics of the terrain leading toward said target including said given ground structure, means for searching the terrain during flight of the missile, and means for comparing characteristics of the searched terrain with said stored terrain characteristics and upon finding agreements therebetween operating said means for causing the missile to follow said parallel lines toward said target.

14. Apparatus as in claim 13 including means in said missile operative in response to the said find of agreement between said characteristics for correcting the flight trajectory of the missile so that the missile will follow said lines toward said target.

15. Apparatus as in claim 13 including means in the missile for causing the missile to fly generally in a horizontal flight path for a time after the comparing means finds said agreement between the stored and searched terrain characteristics.

16. Apparatus as in claim 15 including:

means in said missile for acquiring said target in flight upon reaching a given acquisition range, and means in said missile operative upon the acquisition of the target by said acquiring means for determining the most favorable impact point for impacting said target, and means in said missile for changing the flight path from horizontal to an acute angle relative to the horizontal to lead the missile downward toward said target.

17. Apparatus as in claim 16 including in said missile a warhead with engine means operative after said impact point is determined for separating the warhead from at least part of the missile by accelerating the warhead to a substantially increased approach speed in a flight path straight to said impact point.

18. Apparatus as in any one of claims 12, 13, 14, 15, 16 or 17 wherein said missile initially carries a warhead having a plurality of charges, said apparatus including means for executing said charges in tandem at the target.

19. Apparatus as in any one of claims 12, 13, 14, 15, 16 or 17 wherein said missile initially carries a warhead having a charge, said apparatus including means for triggering said warhead charge only after penetration of a foundation or bed of said target.

* * * * *